US007399069B2

(12) United States Patent
Therien

(10) Patent No.: US 7,399,069 B2
(45) Date of Patent: Jul. 15, 2008

(54) FLUID-EJECTION DEVICE CONNECTOR

(75) Inventor: Patrick J. Therien, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 384 days.

(21) Appl. No.: 11/013,603

(22) Filed: Dec. 15, 2004

(65) Prior Publication Data

US 2006/0077222 A1 Apr. 13, 2006

Related U.S. Application Data

(60) Provisional application No. 60/618,716, filed on Oct. 13, 2004.

(51) Int. Cl.
*B41J 2/17* (2006.01)

(52) U.S. Cl. ..... 347/84; 347/85; 347/49

(58) Field of Classification Search ..... 347/20, 347/84–87, 49, 65–66, 50
See application file for complete search history.

(56) References Cited

U.S. PATENT DOCUMENTS

| | | | | |
|---|---|---|---|---|
| 4,599,628 | A | 7/1986 | Doring | 347/85 |
| 4,709,249 | A | 11/1987 | Hanagata | 347/85 |
| 6,003,981 | A | 12/1999 | Cameron | 347/85 |
| 6,439,699 | B1 | 8/2002 | Silverbrook | 347/65 |
| 6,481,838 | B1 * | 11/2002 | Brugue et al. | 347/85 |
| 6,488,368 | B2 | 12/2002 | Petersen | 347/85 |
| 6,739,701 | B2 | 5/2004 | Silverbrook | 347/49 |
| 2003/0052944 | A1 | 3/2003 | Scheffelin | 347/49 |
| 2003/0122906 | A1 | 7/2003 | Okamoto | 347/86 |

FOREIGN PATENT DOCUMENTS

| | | |
|---|---|---|
| EP | 0 832 748 | 4/1998 |

* cited by examiner

*Primary Examiner*—Juanita D Stephens

(57) ABSTRACT

Apparatus and methods are provided. A fluid-ejection device connector has a body having a plurality of internal channels, a plurality of flexible first couplers protruding from an exterior portion of the body, and a plurality of second couplers protruding from another exterior portion of the body. The internal channels respectively fluidly couple the flexible first couplers and the second couplers.

23 Claims, 6 Drawing Sheets

FLUID-EJECTION DEVICE CONNECTOR

CLAIM OF PRIORITY

This application claims the benefit of U.S. Provisional Application No. 60/618,716, filed on Oct. 13, 2004, and titled FLUID-EJECTION DEVICE CONNECTOR.

BACKGROUND

Many fluid handling systems include a fluid delivery system that supplies fluid to a fluid-dispensing (or ejection) device using conduits connected between the fluid delivery system and the fluid-dispensing device. Such systems can be found in printers in the form of an ink reservoir or ink delivery system connected to a print head. Some printers include a stationary reservoir fixed to a body of the printer and a movable print head that moves across a print media, such as paper, during printing. For such applications, the conduits are usually flexible and threaded around a number of bends before they are connected to the movable print head.

The conduits are typically connected to the print head by fitting them over substantially rigid tubules or the like, which are attached to the print head and connected to ink delivery channels associated with ink-injecting orifices of the print head. For example, the conduits may fit over barbed ends of the connectors. Unfortunately, removing the conduits from the connectors and subsequently reattaching them may result in a leak between the connector and the conduit. Moreover, in certain systems fitting the conduits onto the connectors requires a special tool. Another concern is that, in the absence of coding the conduits to their respective connectors, it is possible to connect a conduit to the wrong connector for color printers, where each conduit supplies different colored ink to the print head.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
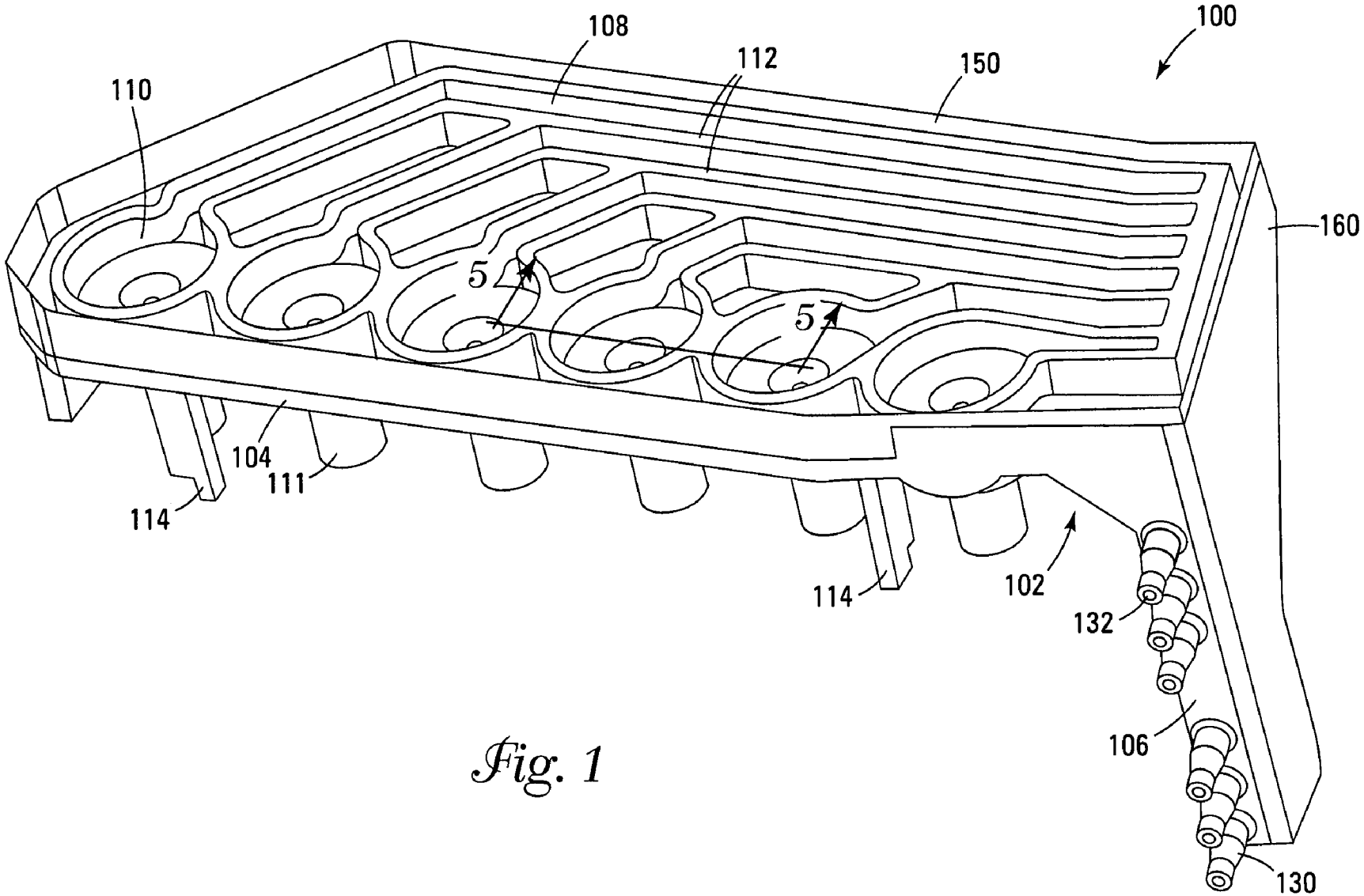
FIG. 1 illustrates an exemplary connector, according to an embodiment of the invention.

FIG. 1 illustrates a connector 100, according to an embodiment of the invention. Connector may be used to connect a fluid-delivery system, e.g., an ink-delivery system, to a fluid-ejection device, such as a print head. Connector 100 includes a body 102 that is substantially rigid. Body 102 includes a first wall 104 and a second wall 106. For one embodiment, the first wall 104 is substantially perpendicular to the second wall 106. A plurality of grooves 108 is formed in the first wall 104. Each of the grooves 108 opens into corresponding one of a plurality of holes 110 that pass through the first wall 104. Each groove 108 is separated from an adjacent groove 108 by a rib 112. A flexible coupler 111 (e.g., a flexible female coupler) extends through each of holes 110 and protrudes from an exterior of the first wall 104. For one embodiment, body 102 is of a light absorbing material (e.g., a black material), such as a light absorbing plastic, e.g., NORYL that may contain polypropylene. For other embodiments, flexible couplers 111 are thermoplastic elastomers, such as Sanoprene, Polypropylene Copolymer, Polyphenylene Ether (PPE), etc.

For one embodiment, a pair of resilient arms 114 extend from the first wall 104. For another embodiment, resilient arms 114 are substantially parallel to couplers 111, as shown in FIG. 1. Resilient arms 114 are adapted to forcibly seat against a print head, for example, when connector 100 is properly connected to the print head. For one embodiment, this indicates that connector 100 is properly connected to the print head. For some embodiments, an audible sound, e.g., a "click" is emitted when resilient arms 114 forcibly seat against a print head, thereby audibly indicating that connector 100 is properly connected to the print head.

Figure 2:
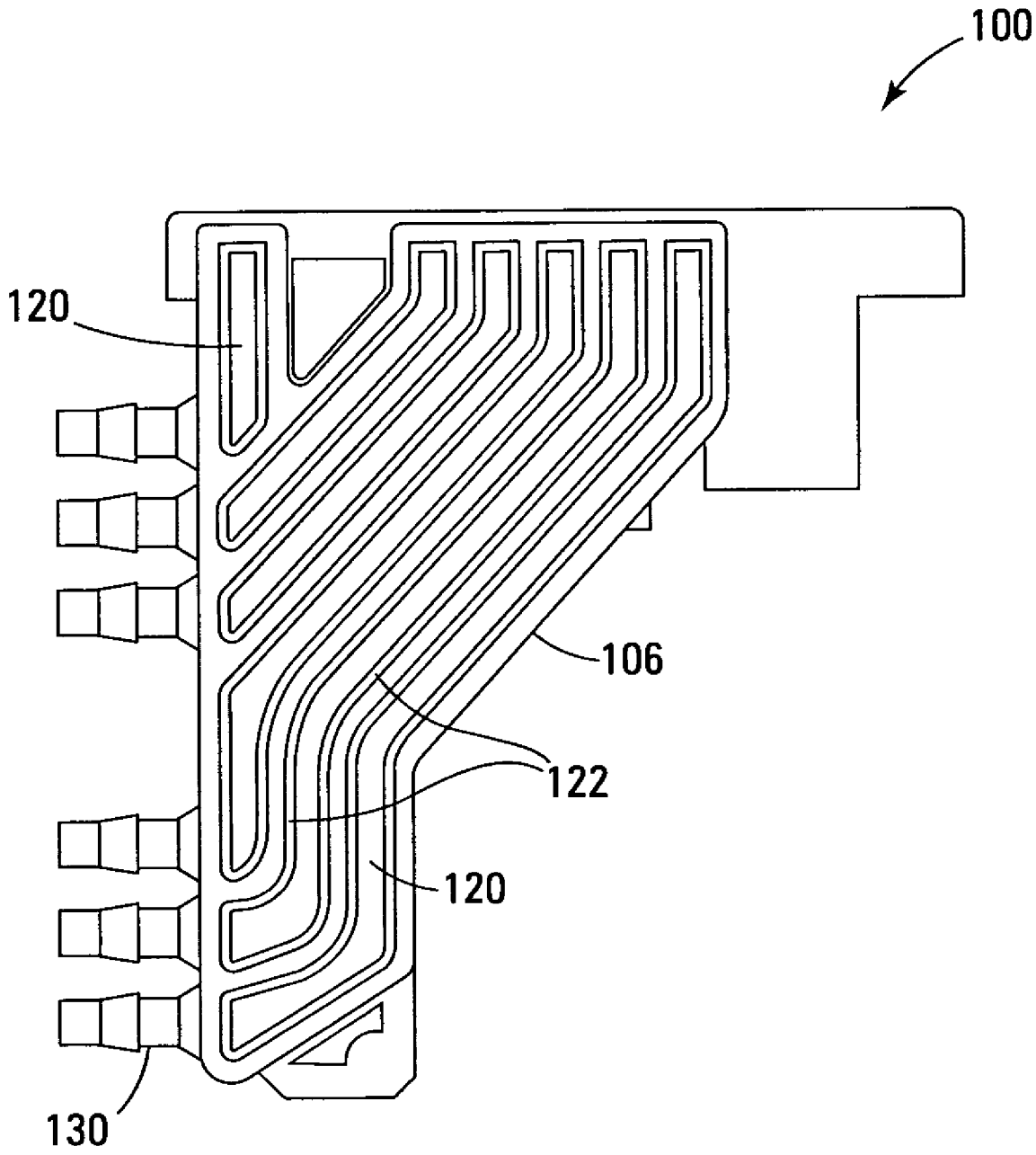
FIG. 2 is a side view of the connector of FIG. 1.

FIG. 2 is a side view of connector 100 that illustrates the second wall 106. A plurality of grooves 120 is formed in the second wall 104. Each groove 120 separated from an adjacent groove 120 by a rib 122. Substantially rigid couplers 130 protrude from an exterior of the second wall 106, as shown in FIGS. 1 and 2. A hole (or flow passage) 132 passes through each of couplers 130 (FIG. 1) and is fluidly coupled to a corresponding one of the grooves 122. For one embodiment, couplers 130 are formed integrally with body 102.

Figure 3:
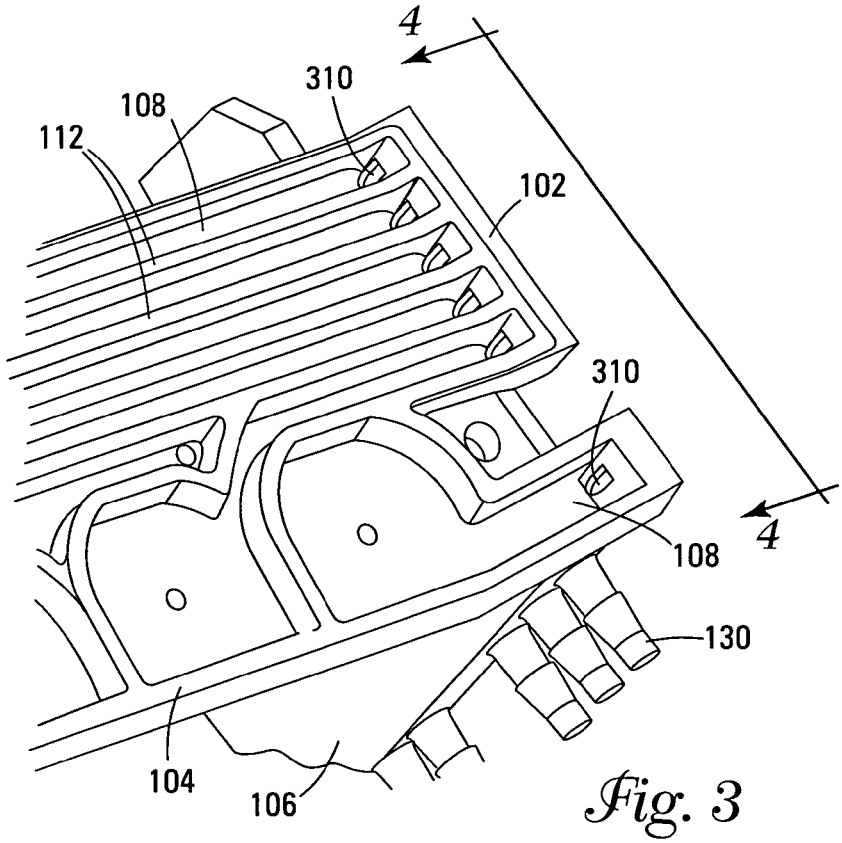
FIG. 3 illustrates a portion of an exemplary connector, according to another embodiment of the invention.
Figure 4:
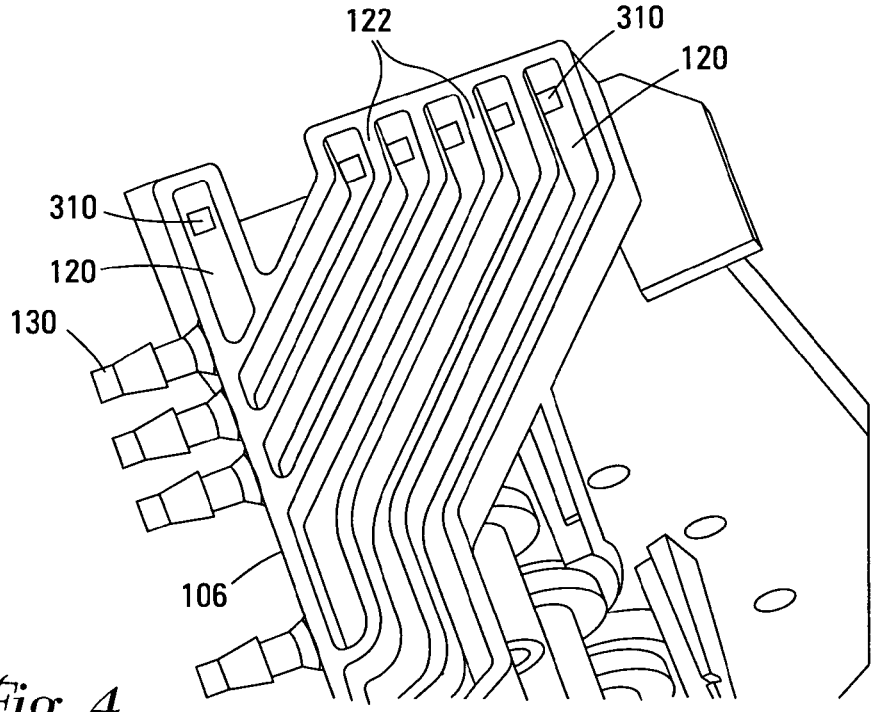
FIG. 4 is a view taken along the line 4-4 of FIG. 3.

FIG. 3 illustrates a portion of a connector, such as connector 100, according to another embodiment of the invention. It is seen that a hole 310 passing through body 102 adjacent to where the first wall 104 is connected to the second wall 106 opens into each of grooves 108. FIG. 4 is a view taken along the line 4-4 of FIG. 3. FIG. 4 shows that each of holes 310 opens into a corresponding one of grooves 120. In this way, a hole 310 fluidly couples each of grooves 108 to a corresponding one of grooves 120.

As best seen in FIG. 1, a first cover 150 overlies the first wall 104 and is adhered to ribs 112. Similarly, a second cover 160 overlies the second wall 106 and is adhered to ribs 122. Covers 150 and 160 respectively close grooves 108 and 120 to form internal flow channels that respectively fluidly couple couplers 111 and couplers 130. For one embodiment, covers 150 and 160 are of a plastic that is substantially transparent to light, such as polyethylene, polypropylene, or the like, and thereby can pass light therethrough. For another embodiment, covers 150 and 160 are suitable for adhering to their respective ribs by heat staking and may be of metal, for example.

Figure 5:
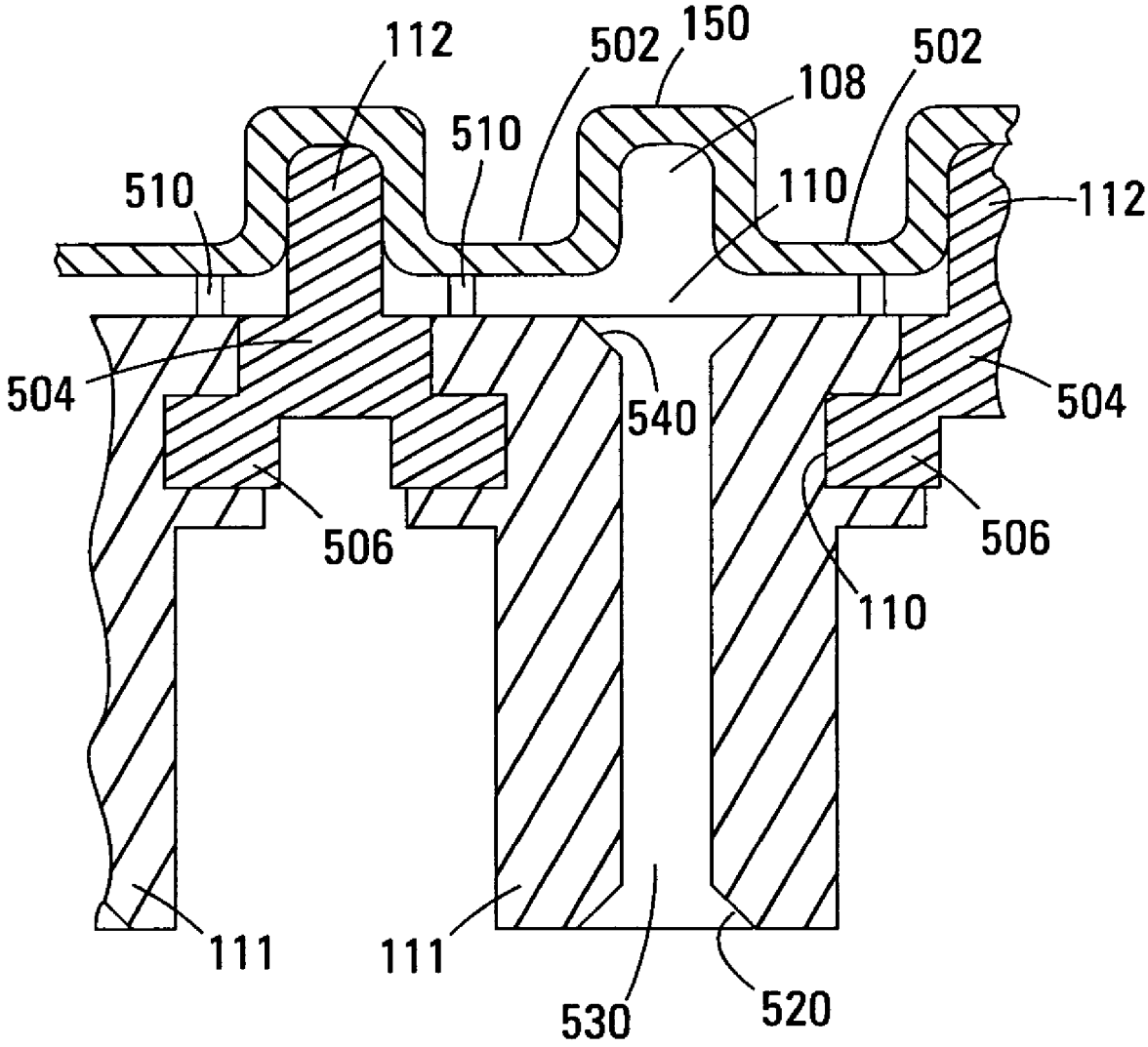
FIG. 5 is a cross-section of a portion of and exemplary connector, as viewed along line 5-5 of FIG. 1, according to certain further aspects of the invention.

FIG. 5 is a cross-section of a portion of connector 100, as viewed along line 5-5 of FIG. 1, according to another embodiment of the invention. For one embodiment, the first cover 150 includes dimples (or recesses) 502 that align with portions of couplers 111 and that extend into holes 110. This acts to reduce the amount of air in the system. For another embodiment, the first wall 150 includes protrusions 504 that for one embodiment are substantially parallel to couplers 111, as shown in FIG. 5. For some embodiments, a portion 506 of successive protrusions 504 extends into the hole 110 located between these successive protrusions 504 to form a lip within that hole 110. For other embodiments, couplers 111 are pressed against the lip so formed by corresponding protuberances 510 protruding from a surface of the first cover 150, as shown in FIG. 5.

For other embodiments, an end of each of couplers 111 includes a chamfer 520 that acts to align a hole 530 passing through that coupler 111 with a tubule protruding from a print head, for example, and thus provides a self-alignment feature. For one embodiment, an opposite end of each of couplers 111 includes a chamfer 540 that acts to reduce head losses to a liquid, such as ink, flowing through the hole 530 within that coupler 111. Note that the holes 530 of couplers 111 are substantially perpendicular to the flow passages 132 of couplers 130, for one embodiment.

For one embodiment, body 102, including couplers 111, is formed using an over-molding process, where body 102 is molded in a first mold, and couplers 111 are over molded onto body 102 in a second mold. Specifically, couplers 111 are molded over protrusions 504 such that portions 506 extend into couplers 111, as shown in FIG. 5. These act to prevent couplers 111 from being pushed or pulled from body 102. For another embodiment, body 102, including couplers 111, is formed within a single mold using a multiple-shot molding process, where one or more shots form body 102 and at least one other shot forms couplers 111.

For another embodiment, covers 150 and 160 are respectively welded, e.g., laser welded, to ribs 112 and ribs 122 using a light beam, e.g. a laser beam, such as a $CO_2$ laser beam. The light passes through covers 150 and 160 and is absorbed by ribs 112 and ribs 122. The light absorbed by ribs 112 and ribs 122 heats ribs 112 and ribs 122 to their melting point, producing molten rib material. Moreover, this heat causes localized melting at the exterior surfaces covers 150 and 160 respectively adjacent ribs 112 and ribs 122, producing molten cover material. This results in intermixing between the molten rib material and the molten cover material at an interface between covers 150 and 160 and their respective ribs 112 and ribs 122, which when solidified welds covers 150 and 160 to their respective ribs 112 and ribs 122. For another embodiment, a molecular exchange occurs between like material components of the molten cover material and the molten rib material, e.g., polypropylene, during welding to form a molecular bond. Alternatively, vibration welding may weld covers 150 and 160 to ribs 112 and ribs 122.

Figure 6:
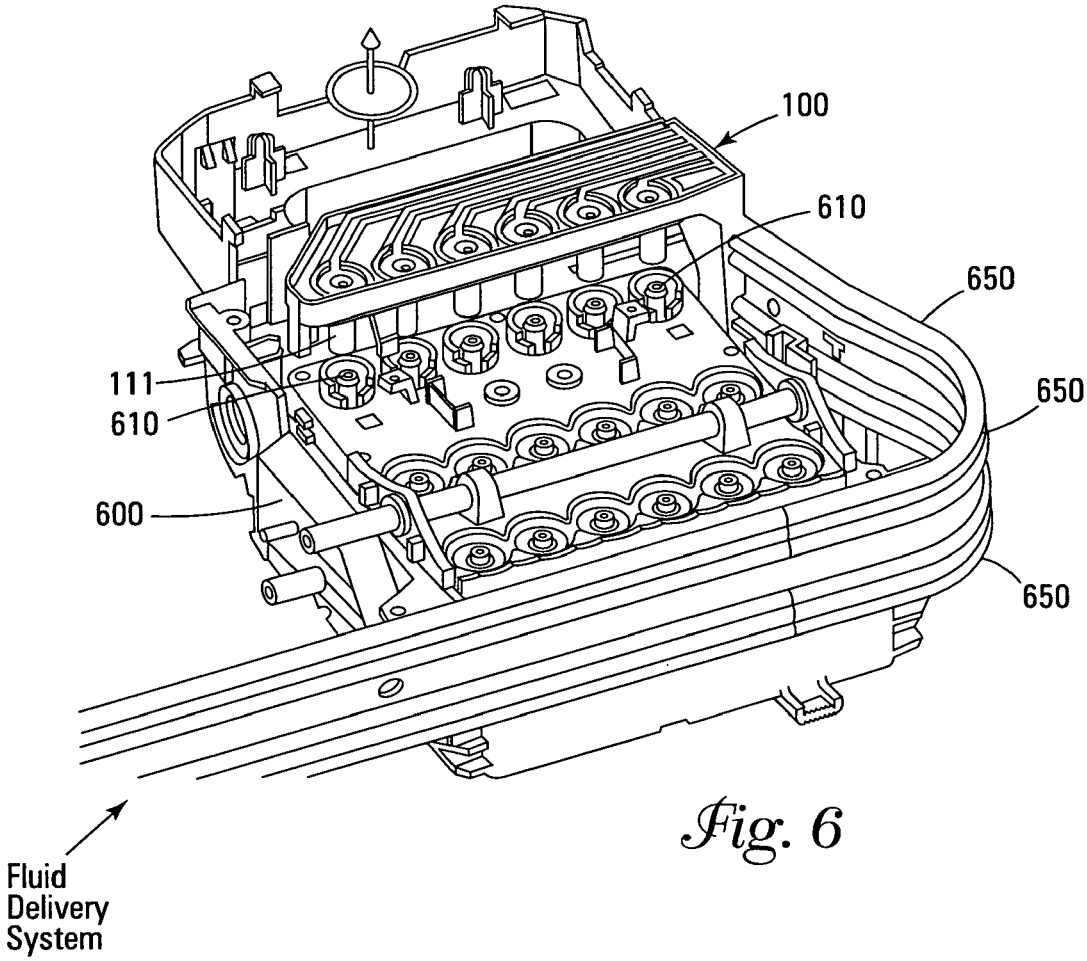
FIG. 6 illustrates an exemplary connector in operation, according to another embodiment of the invention.
Figure 7:
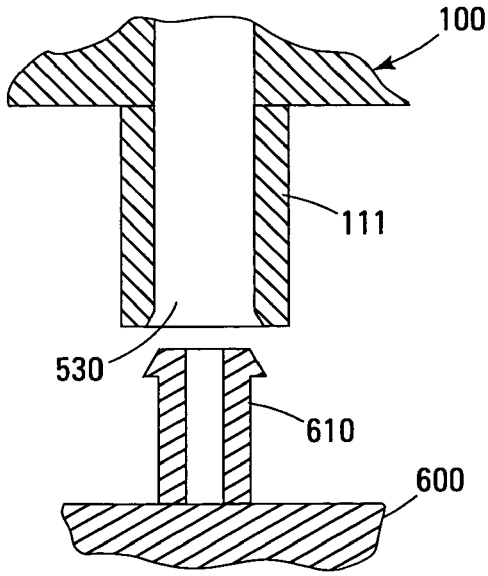
FIG. 7 illustrates a detail of an exemplary connector in operation, according to another embodiment of the invention.

FIG. 6 illustrates connecting a connector, such as connector 100, to a fluid-ejection device 600, e.g., a print head, according to another embodiment of the invention. Couplers 111 are respectively aligned with tubules (or fittings) 610 protruding from fluid-ejection device 600. For one embodiment, each of tubules 610 is barbed, as shown in FIG. 7, for forming a stronger coupling between its corresponding coupler 111. Hole 530 of each coupler 111 receives a tubule 610 therein, as shown in FIG. 7, and the resiliency of that coupler 111 causes it to forcibly engage the tubule 610. Each of flexible conduits (or tubes) 650 receives a corresponding coupler 130 therein at one of its ends. For one embodiment, an opposite end of each flexible tubes 650 is connected to a fluid delivery system, such as an ink delivery system. In this way connector 100 connects tubes that are connected to a fluid delivery system to a fluid ejection device.

For one embodiment, each of tubules 610 is connected to a fluid-ejecting orifice (not shown) of fluid-ejection device 600. For another embodiment, each of tubes 650 carries different colored ink from the fluid delivery system. For this embodiment, connector 100 acts to connect tubes 650 to the proper tubules 610 so that the orifices receive the correct colored ink from the fluid delivery system.

Connector 100 enables all of tubes 650 to be connected to tubules 610 substantially simultaneously instead of one by one when tubes 650 are connected directly to tubules 610, as is conventionally done. Moreover, couplers 111 are generally more robust than tubes 650 and can be repeatedly connected and disconnected from tubules 610 without compromising the seal between couplers 111 and tubules 610. When tubes 650 are connected directly to tubules 610 connecting and disconnecting tubes 650 often compromises the seal between tubes 650 and tubules 610 that can result in leaks. Using connector 100 also enables tubes 650 to be connected to tubules 610 by hand instead of having to use a special tool, as is conventionally done when tubes 650 are connected directly to tubules 610.

Figure 8:
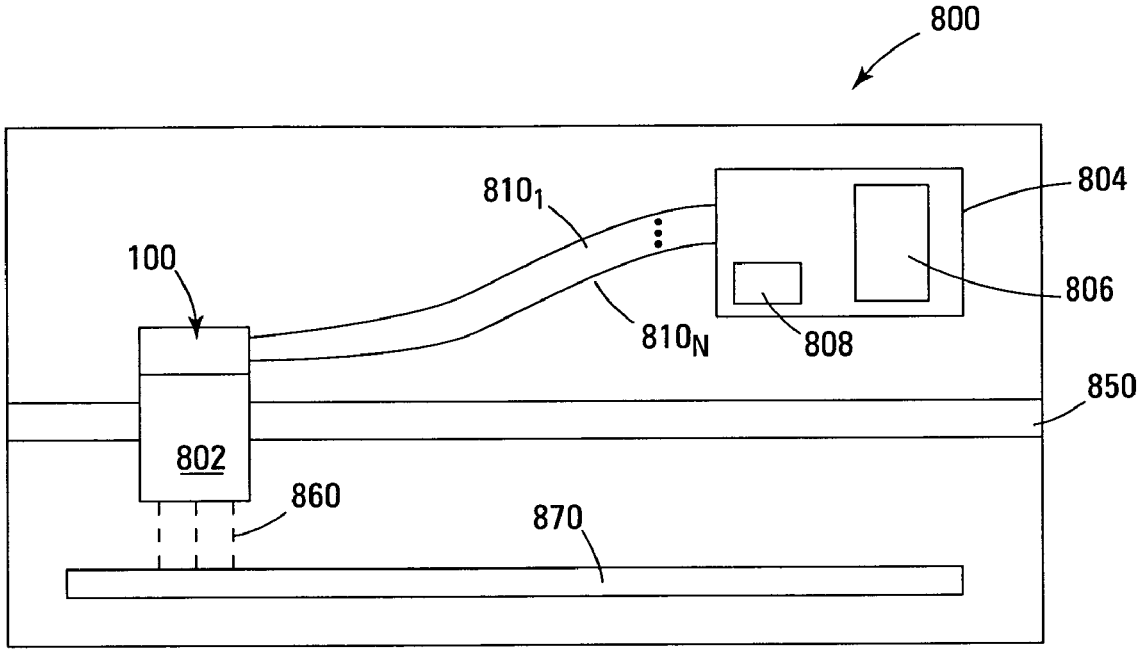
FIG. 8 illustrates an exemplary imaging device, according to another embodiment of the invention.

FIG. 8 illustrates an imaging device 800, such as a printer, according to another embodiment of the invention. Imaging device 800 includes a fluid-ejection device 802, such as an inkjet print head, fluidly coupled to a stationary ink delivery system 804 by flexible conduits 810. More specifically, connector 100 is connected between flexible conduits 810 and fluid-ejection device 802, as described above, for connecting flexible conduits 810 to fluid-ejection device 802. For one embodiment, ink delivery system 804 is fixedly attached to printer 500. For some embodiments, ink delivery system 804 includes an ink reservoir 806 and, for other embodiments, an ink pump 808. Fluid-ejection device 802 is movably attached to a rail 850 of imaging device 800. Fluid-ejection device 802 is capable of ejecting fluid droplets 860, such as ink droplets, onto a printable medium 870, e.g., paper, as fluid-ejection device 802 moves across printable medium 870.

CONCLUSION

Although specific embodiments have been illustrated and described herein it is manifestly intended that this invention be limited only by the following claims and equivalents thereof.

What is claimed is:

1. A fluid-ejection device connector comprising:

a body comprising a plurality of internal channels;

a plurality of flexible first couplers protruding from an exterior portion of the body; and a plurality of second couplers protruding from another exterior portion of the body;

wherein the internal channels respectively fluidly couple the flexible first couplers and the second couplers;

wherein the plurality of internal channels is formed from a plurality grooves in the body and a cover secured to the body for closing the plurality of grooves.

2. The fluid-ejection device connecter of claim 1, wherein the cover is welded to the body.

3. The fluid-ejection device connecter of claim 1, wherein the body is an absorber of light and the cover is substantially transparent to light.

4. The fluid-ejection device connecter of claim 1, wherein the flexible first couplers are over molded onto the body.

5. The fluid-ejection device connecter of claim 1, wherein the flexible first couplers are formed by at least one shot of a multiple-shot molding process.

6. The fluid-ejection device connecter of claim 1, wherein each flexible first coupler includes a chamfer tat acts to align a hole passing through that flexible first coupler with a tubule protruding from the fluid-ejection device.

7. The fluid-ejection device connecter of claim 1 further comprises a pair of resilient anna extending from the body adapted to seat against the fluid-ejection device when the connector is properly connected to the fluid-ejection device.

8. The fluid-ejection device connecter of claim 1, wherein the second couplers are fonned integrally with the body.

9. The fluid-ejection device connecter of claim 1, wherein the first couplers are thermoplastic elastoniers.

10. A print head connector comprising:

a substantially rigid body comprising interconnected first and second walls;

a plurality of first grooves formed in the first wall;

a plurality of second grooves formed in the second wall, the second grooves connected one to one to the first grooves;

a plurality of flexible first couplers protruding from an exterior portion of the first wall, each flexible first coupler disposed in a hole that passes through the first wall such that a hole passing through that flexible first coupler opens into a corresponding one of the first grooves;

a plurality of substantially rigid second couplers protruding from the second wall, a hole passing through each second coupler fluidly coupled to a corresponding one of the second grooves;

a first cover overlying the first wall so as to close the plurality of first grooves; and a second cover overlying the second wall so as to close the plurality of second grooves.

11. The print head connecter of claim 10, wherein the body is an absorber of light and the first and second covers are substantially transparent to the light.

12. The print head connecter of claim 10, wherein each flexible first coupler includes a chamfer that acts to align the hole passing through that flexible first coupler with a tubule protruding from the print head.

13. The print head connecter of claim 10, wherein the first and second covers are welded or heat staked to the first and second walls.

14. The print head connecter of claim 10, wherein the first and second covers are welded to the first and second walls using a beam of light.

15. The print head connecter of claim 10 further comprising a pair of resilient arms extending from the first wall adapted to seat against the print head when the connector is properly connected to the print head.

16. The print head connecter of claim 10, wherein the first couplers is substantially perpendicular to the second couplers.

17. The fluid-ejection device connecter of claim 10, wherein the flexible first couplers are over molded onto the body.

18. The fluid-ejection device connecter of claim 10, wherein the flexible first couplers reformed by at least one shot of a multiple-shot molding process.

19. The print head connecter of claim 10, wherein the second couplers are formed integrally with the body.

20. The print head connecter of claim 10, wherein each flexible first coupler is pressed against a lip formed within the hole that passes through the first wall by a corresponding protuberances protruding from a surface of the first cover.

21. A print head connector comprising:

a means for flexibly connecting a print head connector to tubules of the print head;

a means for substantially rigidly connecting conduits, connected to an inic delivery system, to the print head connector; and a means for fluidly coupling the flexible connecting means to the rigid connecting means.

22. The print head connecter of claim 21 further comprises a means for indicating when the print head connector is connected to the print head.

23. The print head connecter of claim 21, wherein the flexible connecting means comprises a means for aligning the flexible connecting means with the tubules.

* * * * *

UNITED STATES PATENT AND TRADEMARK OFFICE

CERTIFICATE OF CORRECTION

PATENT NO. : 7,399,069 B2
APPLICATION NO. : 11/013603
DATED : July 15, 2008
INVENTOR(S) : Patrick J. Therien It is certified that error appears in the above-identified patent and that said Letters Patent is hereby corrected as shown below:

In column 4, line 56, in Claim 1, after “plurality” insert -- of --.

In column 5, line 2, in Claim 6, delete “tat” and insert -- that --, therefor.

In column 5, line 6, in Claim 7, delete “anna” and insert -- arms --, therefor.

In column 5, line 10, in Claim 8, delete “fonned” and insert -- formed --, therefor.

In column 5, line 12, in Claim 9, delete “elastoniers” and insert -- elastomers --, therefor.

In column 6, line 18, in Claim 18, delete “reformed” and insert -- are formed --, therefor.

In column 6, line 30, in Claim 21, delete “inic” and insert -- ink --, therefor.

Signed and Sealed this

Twenty-first Day of July, 2009

John Doll

JOHN DOLL
*Acting Director of the United States Patent and Trademark Office*